US011260259B2

(12) United States Patent
Benoit

(10) Patent No.: US 11,260,259 B2
(45) Date of Patent: Mar. 1, 2022

(54) WEIGHT PLATE

(71) Applicant: Benoit Built MFG., L.L.C., Boothbay Harbor, ME (US)

(72) Inventor: Kenneth J Benoit, Boothbay Harbor, ME (US)

(73) Assignee: Benoit Built MFG., L.L.C., Boothbay Harbor, ME (US)

( * ) Notice: Subject to any disclaimer, the term of this patent is extended or adjusted under 35 U.S.C. 154(b) by 0 days.

(21) Appl. No.: 17/148,947

(22) Filed: Jan. 14, 2021

(65) Prior Publication Data

US 2021/0339072 A1 Nov. 4, 2021

Related U.S. Application Data

(60) Provisional application No. 63/017,139, filed on Apr. 29, 2020.

(51) Int. Cl.
*A63B 21/072* (2006.01)
*A63B 21/06* (2006.01)

(52) U.S. Cl.
CPC ..... *A63B 21/0728* (2013.01); *A63B 21/0604* (2013.01); *A63B 21/0724* (2013.01); *A63B 21/0726* (2013.01)

(58) Field of Classification Search
CPC ..... A63B 21/0604; A63B 21/072; A63B 21/0722; A63B 21/0724; A63B 21/0726; A63B 21/0728; A63B 21/075; A63B 21/026; A63B 21/02; A63B 21/0004; A63B 21/00189; A63B 21/078; A63B 21/0783; A63B 21/08; A63B 21/4033; A63B 21/4039; A63B 21/4001; A63B 15/00; A63B 2220/00; A63B 2220/52; A63B 2244/00; A63B 2244/09
USPC ..... 482/12, 107
See application file for complete search history.

(56) References Cited

U.S. PATENT DOCUMENTS 4,566,690 A * 1/1986 Schook ..... A63B 21/0728 482/106
6,322,481 B1 * 11/2001 Krull ..... A63B 21/0728 482/106
10,518,123 B2 * 12/2019 Moran ..... A63B 21/075
2005/0075221 A1 * 4/2005 Fond ..... A63B 21/0728 482/93
2006/0189458 A1 * 8/2006 Walkerdine ..... A63B 71/0036 482/106
2007/0254785 A1 * 11/2007 Lin ..... A63B 21/075 482/108
2007/0298940 A1 * 12/2007 Anderson ..... A63B 21/075 482/107
2008/0026921 A1 * 1/2008 Liu ..... A63B 21/063 482/107
2014/0349820 A1 * 11/2014 Wang ..... A63B 21/0726 482/108
2019/0299047 A1 * 10/2019 Nalley ..... A63B 21/0728
2019/0366142 A1 * 12/2019 Dale ..... A63B 15/00
2019/0388723 A1 * 12/2019 Nalley ..... A63B 21/0604
2020/0114204 A1 * 4/2020 Owusu ..... A63B 21/075
2020/0330813 A1 * 10/2020 Liu ..... A63B 21/0728
2020/0376320 A1 * 12/2020 Wang ..... A63B 21/075
(Continued)

*Primary Examiner* — Megan Anderson
*Assistant Examiner* — Thao N Do
(74) *Attorney, Agent, or Firm* — Jeffrey Joyce, Esq.

(57) ABSTRACT

A weight plate that is comprised of multiple parts that connect to each other around the handle of a progressive resistive device.

8 Claims, 7 Drawing Sheets

(56) References Cited

U.S. PATENT DOCUMENTS

| | | | | |
|---|---|---|---|---|
| 2020/0398100 | A1* | 12/2020 | Wang | A63B 21/075 |
| 2021/0146186 | A1* | 5/2021 | Chen | A63B 21/0728 |
| 2021/0187340 | A1* | 6/2021 | Chen | A63B 21/0726 |
| 2021/0322817 | A1* | 10/2021 | Chen | A63B 21/072 |

* cited by examiner

WEIGHT PLATE

BACKGROUND INFORMATION

Field of the Invention

The invention relates to weight plates and in particular types of weight plates that are used for weight lifting exercises and that attach to bars, barbells, kettlebells, selectorized machines, dumbbells, and/or other progressive resistive products.

Discussion of Prior Art

Weight plates are typically flat heavy objects, commonly made of cast iron or steel, and used in combination with barbells or dumbbells or other progressive resistive products, to produce a weighted bar with a desired total weight for particular physical exercises. The plates commonly have a center hole that allows the plate to be mounted over the end of the bar.

One trend that has become more common recently is the design and construction of fixed-weight dumbbells, which are non-adjustable weights created in a dumbbell shape. These weights are often made of cast iron or steel and coated with rubber or neoprene largely for sound deadening, or in some instances made of a rigid plastic shell that is filled with concrete. Such dumbbells come in a variety of weights, but the heavier dumbbells typically come in 5 pound (lbs) increments. This presents a limitation for users that wish to have a finer degree of control at higher weights.

With classic dumbbells and barbells, those that use individual weight plates that are removably attached to a bar, a weightlifter simply adds smaller weight plates to obtain finer adjustments, for example, two plates that each weigh 1.25 lbs with plate attached to either end of the bar. However, with the fixed-weight dumbbells, kettlebells and other similar devices there is no way to add a plate over the bar. With certain dumbbells magnetic plates may be magnetically attached to the outer ends of the dumbbells, however, most modern models include a non-magnetized coating that prevents such a magnetic attachment.

What is needed, therefore, is a weight plate that is attachable to a bar in a manner that does not require the plate to be inserted over the end of the bar, and what is further needed is such a weight plate that may be attached to a fixed-weight dumbbell.

BRIEF SUMMARY OF THE INVENTION

The invention is a weight plate that is formed from at least two sections. Each section has an opening that allows the plate to be inserted over a bar from a side-on direction rather than over the end of the bar, for example, over the handle portion of a fixed-weight dumbbell or kettlebell. The at least two sections include at least one male section and one female section, the male section joining with the female section to form a weight plate that is connectable around a bar and/or handle portion of the bar. The sections may also use magnets to further secure the at least two sections to one another and in place on the bar.

A particularly useful embodiment of the invention has each combined weight plate weighing 1.25 pounds and used with fixed-weight dumbbells. This allows people to progress in weight resistance in smaller increments, which is normally not available with the current fixed dumbbells that increase in 5 pound increments. Without the inventive device an individual is forced to buy each dumbbell in 2.5 lbs increments, which is very expensive. With the inventive device the individual only has to purchase the dumbbells in 5 lbs increments and simply attach one of the combined weight plates to either end of the dumbbell, thus affording them to increase the weight by 2.5 lbs increments.

The inventive device may also be used with barbells, kettlebell, selectorized machines, non-fixed-weight dumbbells, and/or other progressive resistive products.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
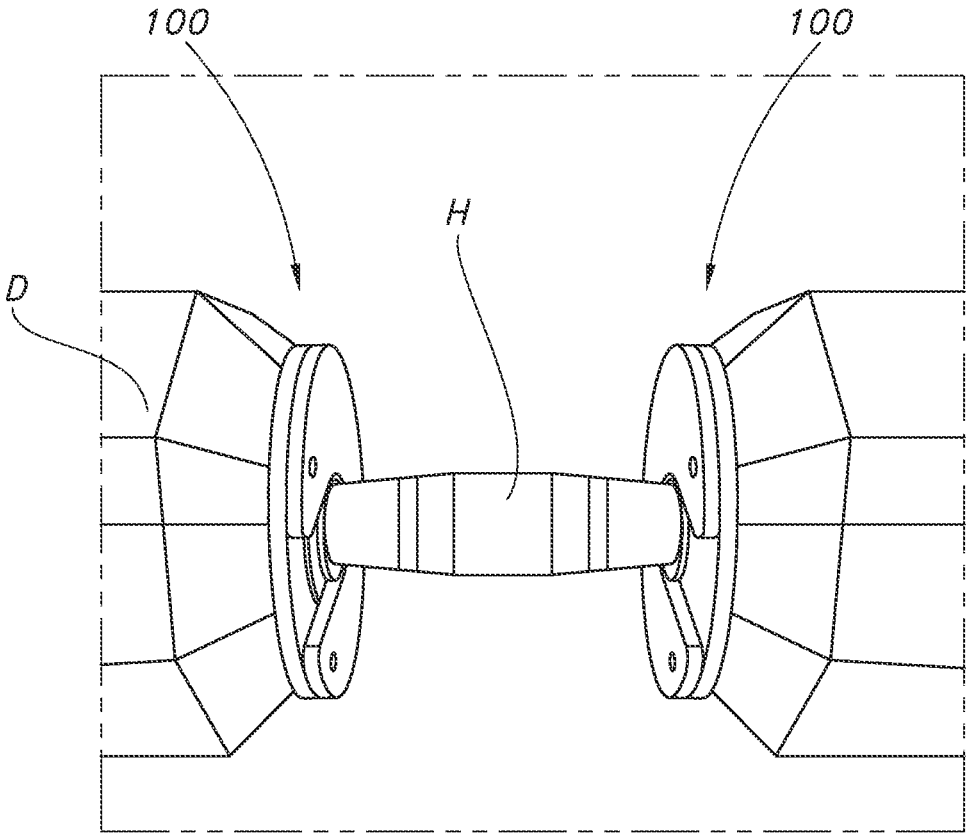
FIG. 1 is a photo showing the device in use on a dumbbell.

FIGS. 1-15 illustrate the weight plate 100 according to the invention, including at least a female plate part 10 and a male plate part 30, the male and female plate parts 10, 30, configured to connect around the handle of a dumbbell, barbell, kettlebell, to a selectorized device, and to other similar progressive resistive products. FIG. 1, in particular, illustrates two sets of connecting plate parts 10, 30, on either end of a dumbbell D handle H. While the plates 100 may be made in any suitable size and of any suitable weight, FIG. 1 illustrates a particularly useful embodiment of the weight plate 100. Here, each set of plates 100 weighs 1.25 pounds ("lbs"), such that the two sets of plates combine to add 2.5 lbs to the dumbbell. As previously noted, it is most common for fixed-weight dumbbells to come in 5 lbs increments, and so this embodiment provides both an economical and convenient manner in which users may create smaller weight increments.

In the embodiment shown, each of the female plate part 10 and the male plate part 30 are largely shaped like a conventional weight plate but each has a cutout 12, 32, that allows the respective plate 10, 30, to slide over the handle H from a side of the handle rather than being inserted over the end of the dumbbell or barbell in the manner of conventional weight plates.

FIGS. 4-7 illustrate the female plate 10, which includes an inner side 14 and an outer side 16. Outer sider 16 is largely smooth, while the inner side 14 includes a female connector 18 that is a slight indentation, or depression, relative to the surface of the inner side 14.

FIGS. 8-11 illustrate the male plate 30, which includes an inner side 34 and an outer side 36. Outer sider 36 is largely smooth, while the inner side 34 includes a male connector 38 that is a slight protrusion, or elevation, relative to the surface of the inner side 34.

The cutouts 12, 32, and the female and male connectors 18, 38, may have approximately the same size and dimensions. For example, the plate parts may have a diameter of 4.5 inches, the cutouts may measure 2.5 inches in width, and the connectors may extend 1 inch into the plate part lengthwise.

Alternatively, the female plate 10 may have a cutout 12 and connector 18 that are slightly elongated relative to the male components 32, 38, to allow the male plate part to be placed at different locations relative to the female plate part around the handle H of a device D. Making the opening between the male plate part 30 and the female plate part 10 smaller causes the weight plate 100 to have a tighter and better fit that leads to less wobbling of the plates 10, 30 against the device D and reduces or eliminates pinching between the user and the plates 10, 30.

Figure 2:
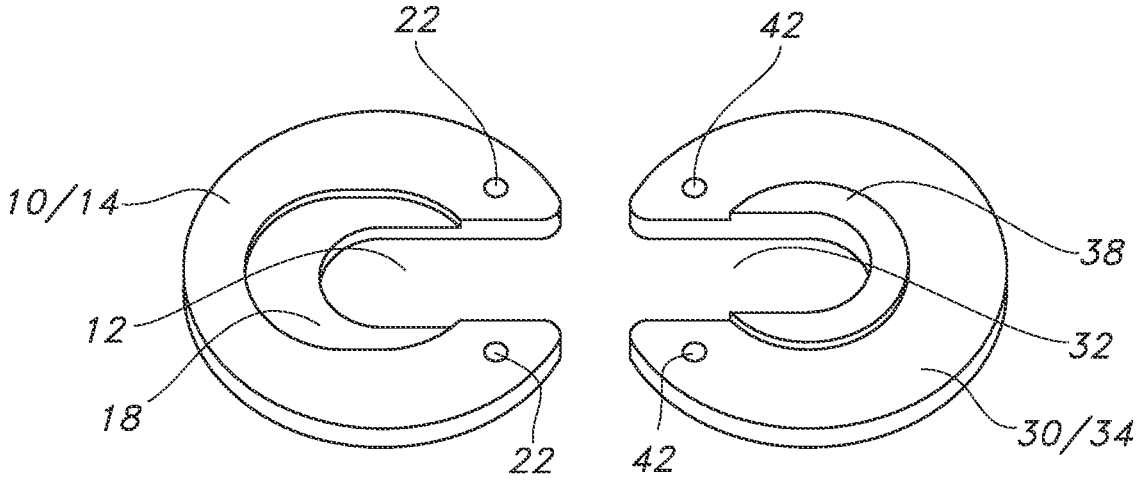
FIG. 2 is a photo showing the two plates separated.
Figure 3:
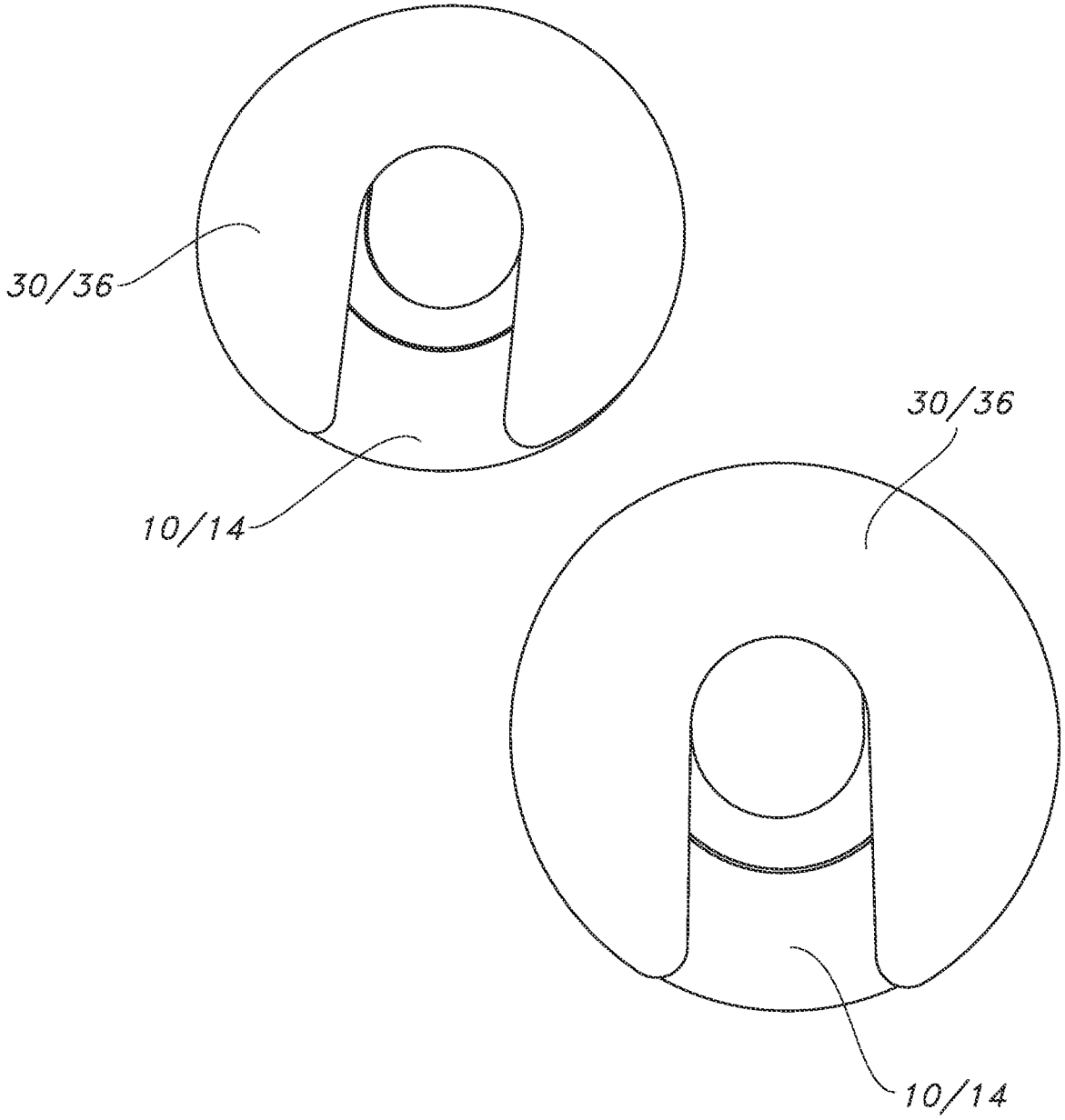
FIG. 3 is a photo showing two pairs of plates connected.
Figure 5:
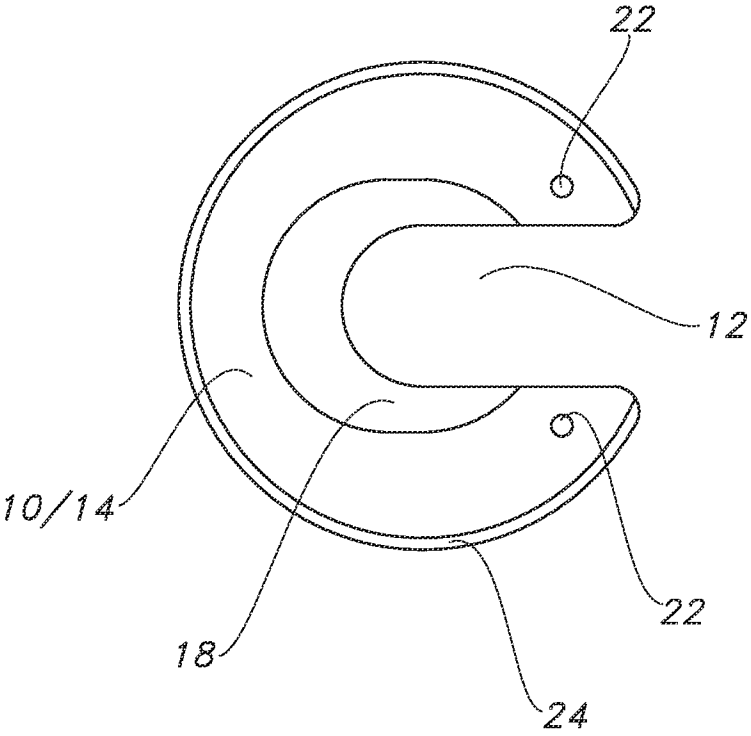
FIG. 5 is an inner side view of the female plate part.
Figure 6:
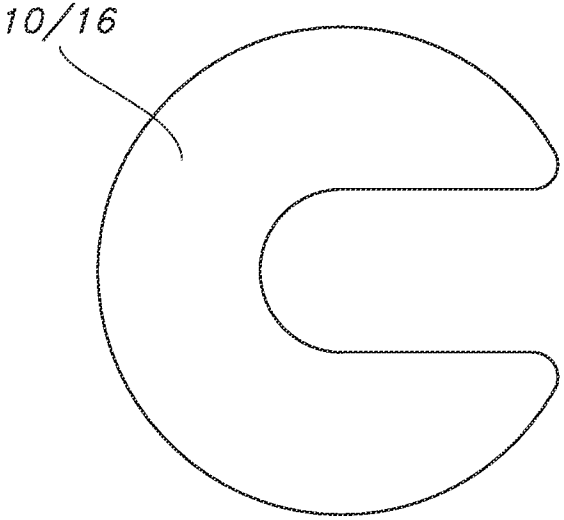
FIG. 6 is an outer side view of the female plate part.
Figure 4:
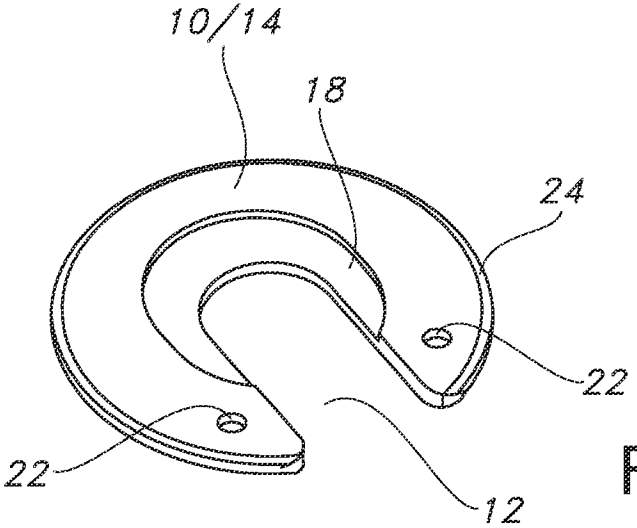
FIG. 4 is perspective view of a female plate part.
Figure 7:
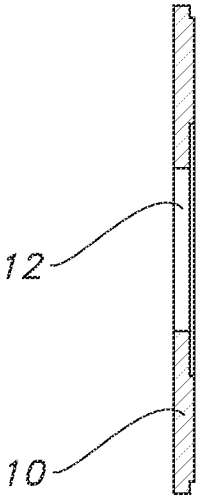
FIG. 7 is a side view of the female plate part.
Figure 11:
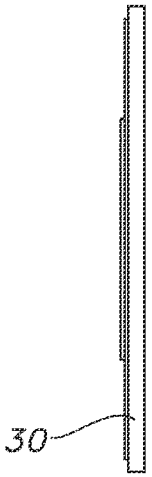
FIG. 11 is a side view of the male plate part.
Figure 10:
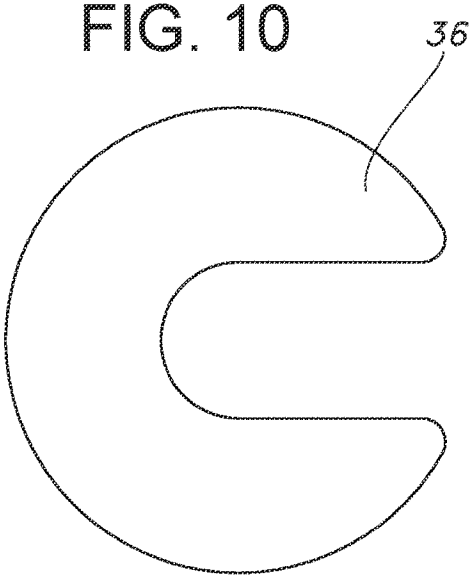
FIG. 10 is an outer side view of the male plate part.
Figure 9:
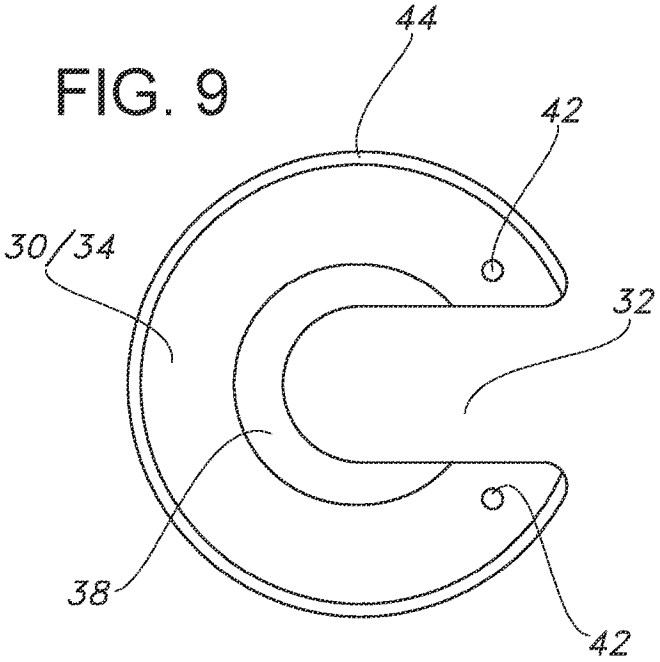
FIG. 9 is an inner side view of the male plate part.
Figure 8:
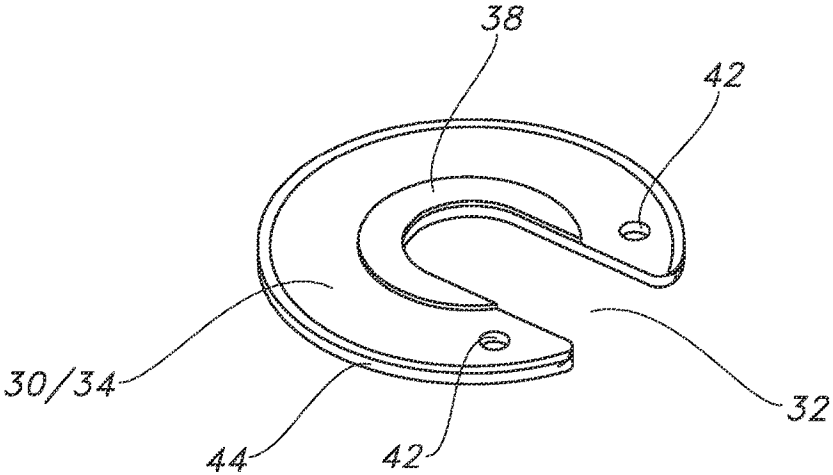
FIG. 8 is a perspective view of a male plate part.
Figure 15:
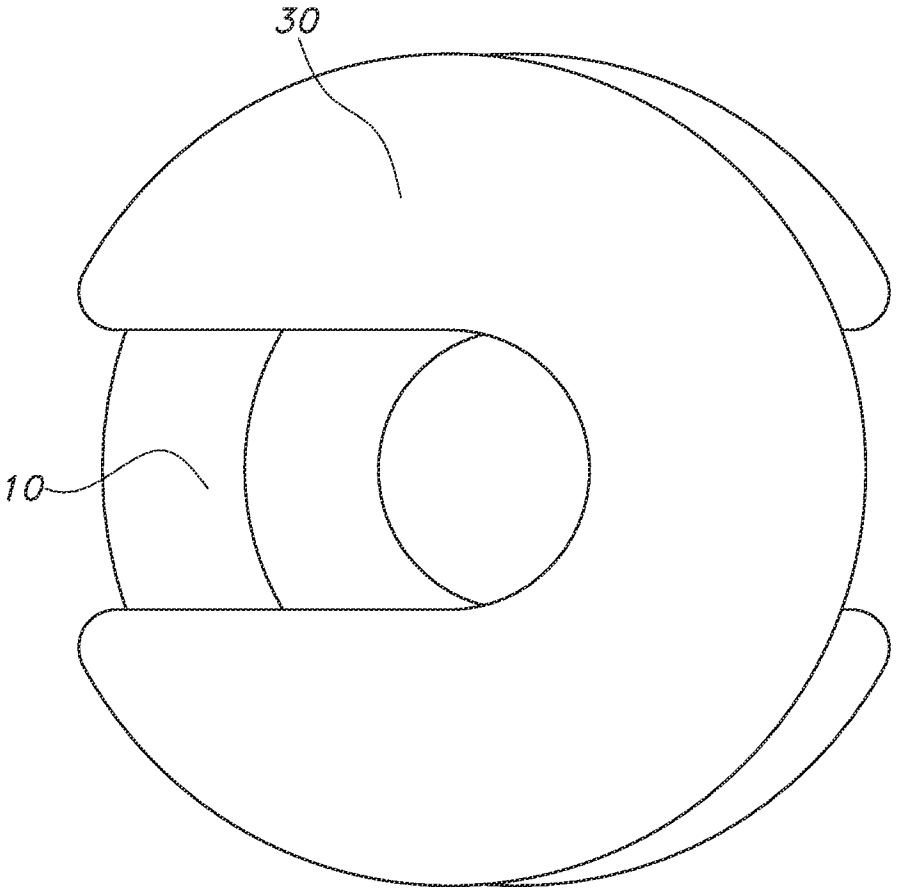
FIG. 15 illustrates two plates connected in a manner that creates a smaller opening between the plates.

FIG. 2 illustrates one embodiment where the female cutout 12 and connector 18 are elongated relative to the male cutout 32 and connector 38, and FIG. 15 illustrates how these two plates 10, 30 may be inserted together to create a smaller opening. In this embodiment, while a number of dimensions may be suitable depending on the desired weight of the plates, the plates 10, 30 may each have a diameter of roughly 3½ inches. The cutout 12 on the female plate 10 may be 2¼ inches, the cutout 32 on the mail plate 30 may be 2 inches. The length of the indented or depressed portion the female connector 18 may be ½ inch, leaving approximately ¾ inch material to the outer edge of the plate, while the raised or elevated portion of the male connector 38 may be ⅜ inch, leaving roughly 1⅛ inch of material to the outer edge of the plate.

In use, a weight lifter inserts the male plate 30 and the female plate 10 over the handle H of the dumbbell D from opposite directions, with the inner sides 14, 34, of each plate facing one another. Once the two plates are fully inserted over the handle the male connector 38 and female connector 18 come together to secure the plates in a fixed position relative to one another.

Each plate may also include one or more magnets 22, 42, to further secure the plates in position. The manner in which the magnets are inserted into the plates is important and incorrect placement may lessen their functionality. Specifically, the magnets do not perform well if they are potted in the plates 10, 30, meaning that the sides of the magnets may not be in contact with the sides of the weight plates 10, 30, but have a small gap between the outer edge of each magnet and the plate 10, 30. The magnets may be held in place, for example, by an adhesive, and it is also possible to pot the very end of the magnet while leaving the majority of the magnet separated from the plates 10, 30.

Additionally, each plate may also have a slightly sloped outer edge, also referred to as a continuous relief area, 24, 44, around the outer diameter on the adjoining male and female surfaces, to create a space that enables the user to insert a finger/finger nail or a thin device such as a flat headed screwdriver or utility tool to separate the plates and break the magnetic force holding them together.

Figure 13:
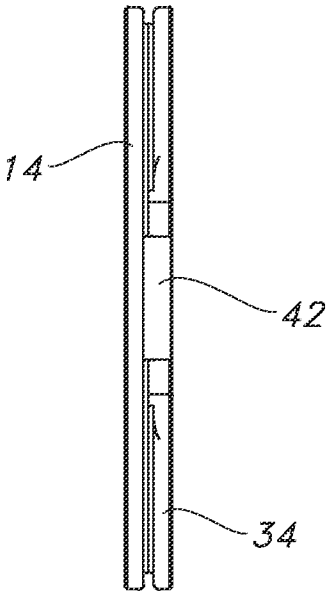
FIG. 13 is a side view of two connected plates showing the securing mechanism.
Figure 12:
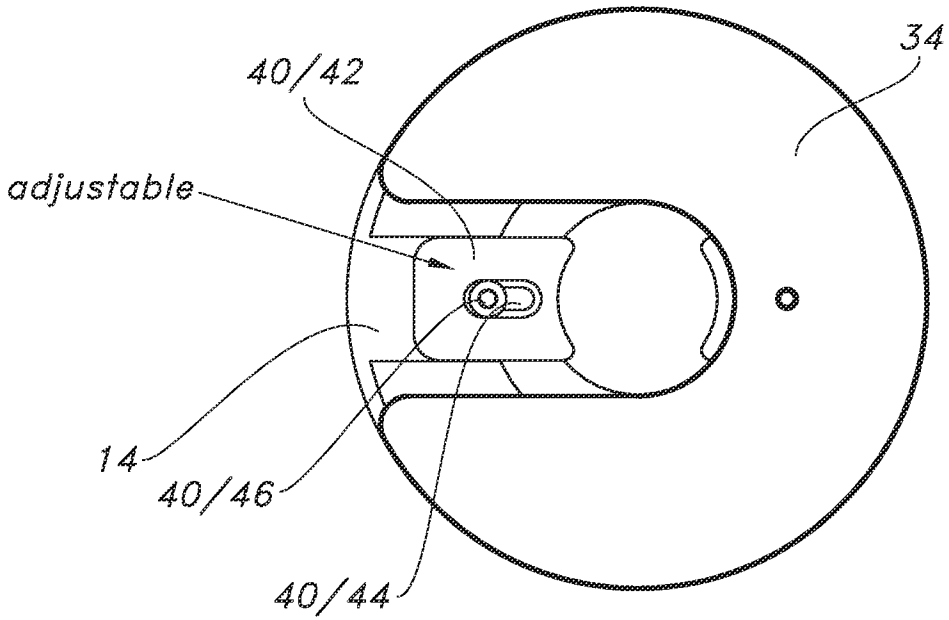
FIG. 12 is a top view of two plates connected with an additional securing mechanism.
Figure 14:
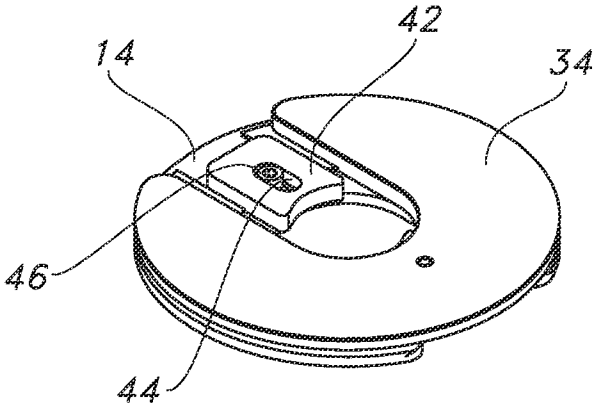
FIG. 14 is a top perspective view of the connected plates with the securing mechanism.

FIGS. 12-14 illustrate an additional securing mechanism 40 that includes a securing member 42 that an opening 44 upon which a fastener 46 is inserted through the member 42 and into the plate 10/30. The fastener 46, which may be any suitable conventional fastener such as a threaded fastener, may be tightened or loosened within the plate, and when the fastener 46 is tightened it secures the member 42 in the desired location. To use the securing mechanism 40 to further secure the plate 100 in the desired position the plates 10, 30 are inserted over the handle H, the fastener 46 is loosened and the member 42 pushed against the handle H, after which the fastener 46 is tightened to keep the member 42 in place.

The plates 10, 30, may be made of any suitable conventional material such as, for example, cast iron. Many magnets that attract to the plate material may be suitable, for example, rare earth magnets. As noted above, a particularly useful embodiment includes a connecting weight plate having a total weight of 1.25 lbs. However, the plates may be made to be any weight. In each set, it is likely that female plate is slightly lighter than the male plate due to the female connector requiring less material while the male connector includes more material.

It is understood that the embodiments described herein are merely illustrative of the present invention. Variations in the construction of the weight plate may be contemplated by one skilled in the art without limiting the intended scope of the invention herein disclosed and as defined by the following claims.

What is claimed is:

1. A weight plate adapted to fit around a handle of a progressive resistive device, the weight plate comprising:

at least one male plate part and at least one female plate part, each of the at least one male plate part and the at least one female plate part including a cutout that extends from a position at a center portion of the respective plate part outward through a side of the respective plate part;

the at least one male plate part further including a male connector and the at least one female plate part further including a female connector; and wherein the at least one male connector and the at least one female connector are adapted to connect to one another and secure the weight plate around the handle when the at least one male plate part and the at least one female plate part are inserted over side portions of the handle from directions that are opposite one another.

2. The weight plate of claim 1, further including a securing member on either the at least one female plate part and/or the at least one male plate part that aids in securing the weight plate to the progressive resistive device.

3. The weight plate of claim 2, wherein the securing member is adjustably attached to either the at least one female plate part and/or the at least one male plate part.

4. The weight plate of claim 1, wherein the at least one female plate part has an inner side and an outer side and wherein the female connector is an indentation on the inner side.

5. The weight plate of claim 1, wherein the at least one male plate part has an inner side and an outer side and wherein the male connector is a protrusion on the inner side.

6. The weight plate of claim 1, wherein either the at least one female plate part and/or the at least one male plate part includes magnets that aid in keeping the at least one female plate part and the at least one male plate part connected around the handle of the progressive resistive device.

7. The weight plate of claim 1, wherein either the at least one female plate part and/or the at least one male plate part has an outer edge that is sloped.

8. The weight plate of claim 1, wherein the female connector has an elongated shape relative to the male connector that is configured to allow a user to create a wider or smaller opening between the respective plate parts around the handle.

* * * * *